United States Patent [19]

Kitta et al.

[11] Patent Number: 4,557,087

[45] Date of Patent: Dec. 10, 1985

[54] METALLIC SHEATH FOR A POSTTENSIONING METHOD PROVIDED WITH RUST PROOFING TREATMENT

[75] Inventors: Toshiyuki Kitta, Omiya; Wataru Abe, Hiratsuka, both of Japan

[73] Assignees: Japanese National Railways; Oiles Industry Co., Ltd., both of Tokyo, Japan

[21] Appl. No.: 528,423

[22] Filed: Sep. 1, 1983

[30] Foreign Application Priority Data

Sep. 4, 1982 [JP] Japan ..... 57-153368
Dec. 16, 1982 [JP] Japan ..... 57-219322

[51] Int. Cl.[4] ..... E04C 3/10

[52] U.S. Cl. ..... 52/230; 428/418; 52/309.13

[58] Field of Search ..... 57/223 L, 223 R; 52/230, 309.13; 428/413, 418

[56] References Cited

U.S. PATENT DOCUMENTS

| | | | |
|---|---|---|---|
| 3,513,609 | 5/1970 | Lang | 52/230 |
| 3,646,748 | 3/1972 | Lang | 52/223 |
| 3,909,424 | 9/1975 | Clark | 252/12 |
| 3,922,437 | 11/1975 | Kitta | 52/223 |
| 3,963,450 | 6/1976 | Davies | 164/411 |
| 4,037,979 | 7/1977 | Fastenau | 52/230 |
| 4,068,963 | 1/1978 | Brandestini | 403/268 |
| 4,363,462 | 12/1982 | Wlodkowski | 52/230 |
| 4,442,646 | 4/1984 | Prevedini | 52/230 |

*Primary Examiner*—John E. Murtagh
*Assistant Examiner*—Kathryn Ford
*Attorney, Agent, or Firm*—Armstrong, Nikaido, Marmelstein & Kubovcik

[57] ABSTRACT

A metallic sheath for a posttensioning method wherein an outer peripheral surface or outer and inner peripheral surfaces thereof is (or are) coated with phosphate layer (or layers) and plastic resin layer (or layers) thereupon and preferably further coated with a solid lubricating layer upon the inner peripheral surface of the sheath.

The phosphate layer of the outer peripheral surface protect the metallic sheath from corrosion by negative ion within concrete, while, on the other hand, that of the inner peripheral surface prevents the electrochemical corrosion between the inner peripheral surface of the sheath and tendon.

Moreover, if a solid lubricating, layer is provided at the inner peripheral surface of the sheath, the sliding friction between the metallic sheath and tendon can be decreased so that prestressed force can be increased as much.

2 Claims, 4 Drawing Figures

METALLIC SHEATH FOR A POSTTENSIONING METHOD PROVIDED WITH RUST PROOFING TREATMENT

BACKGROUND OF THE INVENTION

This invention relates to a metallic sheath used for prestressed concrete structures constructed through a posttensioning method, and more specifically, to a metallic sheath provided with rust proofing treatment.

Generally, when a prestressed concrete structure is executed by a posttensioning method, metallic sheathes are normally used because a tendon is arranged. The metallic sheath has a function as a cover for the tendon so that the tendon is insulated from concrete and thus can be tensioned.

The metallic sheath allows the tendon to be arranged smoothly, and have strength enough to withstand a collapse thereof or formation of holes therein when concrete is placed.

Frictional resistance must be small when the arranged tendon is prestressed. The inventors of this invention has invented a metallic sheath whose inner peripheral surface is coated with a coating in order to solve the above problem and has filed a patent application, U.S. Ser. No. 441,080, now allowed with USPTO.

In addition to the above problem on a metallic sheath, however, rust-proofing effect (corrosion resistance) thereof has become an important problem lately.

Cases are getting conspicuous recently that when the concrete structures like the prestressed concrete structures (hereinafter referred to as PC structure) and the reinforced concrete structures (hereinafter referred to as RC structure) are built under sea water or adjacent to the seashore, or when shore sand is used for concrete aggregate material, the tendon within the concrete is corroded at a speed quicker than expectation and therefore the concrete structures themselves are damaged through the corrosion caused by the abound existence of negative ion like halogen ion (for example $Cl^-$, $Br^-$, $I^-$, $SO_4^{--}$, $S^{--}$ and others), especially, of chlorine ion.

In the PC structure cases, the metallic sheath covering the tendon is directly corroded by negative ion (called as corrosion ion) so that, centering said corroded sheath, the concrete as well as the tendon around said sheath are also damaged or corroded, which causes the infirmity of whole PC structures.

In these PC structures, in addition, electrochemical corrosion occurs by the contact or the close access between the metallic sheath and the tendon and fosters the infirmity of the PC structure.

In the prior art, rust-proofing treatment such as zinc plating was applied upon the metallic sheath to prevent them from rusting when they were to lay aside for several months at the seashore or places like that or when it required a long time before they were imparted with prestressing operation after they were arranged.

In this prior art, however, the main purpose was to reduce the friction between the metallic sheath and the tendon therewithin, or merely to prevent from rusting which would increase the frictional resistance. It was not considered at all about the corrosion caused by the permeation of chlorine ion and the like during a long time of period after the concrete was placed.

Said zinc plating has no effect to control the electrochemical corrosion generated by the contact or the close access between two different kinds of metals in chlorine ion atmosphere.

Moreover, when the inner peripheral surface of the sheath began to corrode by said electrochemical corrosion or the corrosion caused by the peeling-off of rust-proofing-layer by tendon during prestressing operation, the corrosion advanced toward the outer peripheral surface of the sheath, then progressed at an accelerated speed. There was no effective countermeasure to prevent this corrosion starting from the inner peripheral surface of the sheath so far.

SUMMARY OF THE INVENTION

From the results of various studies, the present invention has been developed.

A metallic sheath for a posttensioning method of the present invention has an improved rust-proofing performance much better than a metallic sheath of prior art.

For another object, the present invention provides a metallic sheath having good corrosion resistance against that will occur from an inner peripheral surface of the metallic sheath.

A metallic sheath for a posttensioning method of the present invention comprises the following elements.

(1) A phosphate coating (or coatings) applied to an outer peripheral surface (or inner and outer peripheral surfaces) of the sheath made of a hollow steel tube, (2) a plastic resin coating (or coatings) applied upon said phosphate coating (or coatings), and (3) if necessary, a solid lubricating coating applied upon the plastic layer of the inner peripheral surface of the sheath.

The phosphate coating, preferably provided at both inner and outer surfaces of the sheath, has preferably such thickness that it does not impair the flexibility of the sheath. In an alternative embodiment, the inner coating may be omitted.

Other objects, features and attendant advantages of the present invention will become more fully appreciated as the same becomes better understood from the following detailed description when considered in connection with the accompanying drawings in which like reference characters designate like or corresponding parts and wherein, FIG. 1 shows a metallic sheath for a posttensioning method provided with a phosphate coating and a plastic-resin coating upon an outer peripheral surface of the sheath.

DETAILED DESCRIPTION OF THE INVENTION

Figure 1:
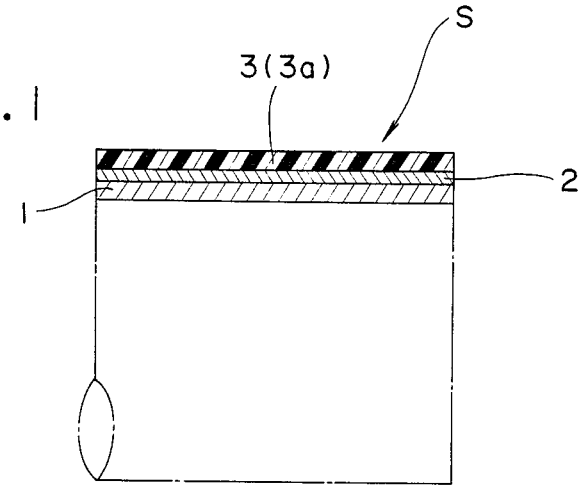

A plastic resin coating applied upon an outer (or outer-and-inner) peripheral surface of a phosphate-coated metallic sheath is chosen from such materials which retain the flexibility of the sheath and have durability against corrosive ions in concrete. Epoxide resin, vinyl chloride resin, or furan resin are, for example, suitable for such materials. Plastic resin coating, especially epoxide resin, adheres well to a phosphate chloride coating.

A solid lubricating coating preferably applied upon the inner side of the metallic sheath is chosen from such materials which have rust-proofing property for itself and, at the same time, decrease the sliding frictional resistance between the inner surface of the sheath and the tendon when tensioned.

Compositions of polytetrafluoroethylene resin (hereinafter referred to as PTFE) and binder, or of PTFE and soft metal, or of metallic sulfide and binder are used for such material.

Though the performance of a solid lubricating coating generally depends upon the hardness of a foundation coating thereunder, the thickness of the plastic resin coating of this invention is very thin and it is proved by the experiment that the plastic resin coating does not impair the frictional performance of the solid lubricating coating.

The metallic sheath of the present invention composed as shown above has following rust-proofing action. That is, the phosphate coating applied to the outer peripheral surface of the metalic sheath displays the rust-proofing property continuously resisting against the corrosion ion within concrete. Plastic resin coating such as exproxide resin and others upon the phosphate coating has rust-proofing property for itself to protect said phosphate coating and, at the same time, amends pinholes, if formed at the coating creation treatment, within said phosphate coating, thereby doubly protecting the metallic sheath from peripheral corrosion.

Moreover, when the metallic sheath is provided with a phosphate coating, a plastic resin coating, and a solid lubricating coating in that order upon the inner periferal surface of the sheath, the structure, avoiding the direct contact between the metallic sheath and the tendon, performs the action to depress, for a long time of period, the metallic corrosion caused by local current when said direct contact happened, while providing rust-proofing property against corrosive ion within concrete (grout) filled into the inside of the sheath.

In addition, rust-proofing property of the sheath, beside its effectiveness within concrete, also performs sufficiently when it is exposed for a long time in the outside atmosphere during storage of prestressing process.

Each constituent of the metallic sheath of the present invention has following peculiar meritorious effects.

(1) Phosphate coating firmly adheres to the metalic sheath and its treatment is easy. Rust-proofing property of the phosphate coating is not impaired by chemical action, lasts for a long time, and is consequently suitable as material used for concrete structures.

(2) When plastic resin coating is applied to a metallic sheath holding phosphate coating between them, adhesion of the plastic resin coating to the sheath is strengthened. Moreover, the plastic resin coating applied to the outer peripheral surface of the sheath (outer-peripheral plastic-resin-coating) has good adhesion property to concrete so that adaptability of the sheath to concrete is improved.

(3) Solid lubricating coating, having rust-proofing property of itself, has good friction decreasing effect between the sheath and the tendon during prestressing process so that it enables to introduce large prestressing force.

(4) Plastic resin coating applied to the inner side of the sheath (inner-peripheral plastic-resin-coating) is difficult to peel off even when the solid lubricating coating has peeled off during prestressing operation and thus well protects the inner phosphate coating preventing such peeling-off from spreading throughout all the coating. Moreover, even if rust-proofing performance of the solid lubricating coating has weakened, the inner periphery of the sheath still provides fine rust-proofing property because that of the plastic-resin coating, together with that of phosphate coating, is excellent. As a result, the inner-peripheral plastic-resin coating provides excellent effects both on mechanical strength of the inner peripheral surface of the sheath (or against peeling off) and on rust-proofing.

The embodiments of the present invention are as follows.

The main body of a metallic sheath, made of a sheet steel, is usually formed by coiling a band steel spirally and welding its seam. Those parts having curved portion of about right angle, however, may be used the one made from thick bend tube.

Phosphate coating applied to the outer or outer-and-inner peripheral surface of a metallic sheath is coated by several desirable methods like mangan phosphate method (principal component of treatment liquid: Mn $(H_2PO_4)2)$, zinc phosphate method (supra: Zn $(H_2PO_4)2)$, and ion phosphate method (supra: $NaH_2PO_4$) (omits other methods).

If the coating is executed with finishing treatment by Endurion method, rust-proofing property is more improved. The thickness of the coating is preferably from 5 to 10 microns. Method for forming the coating can be chosen from any one of suitable methods like immersion coating or spray coating. As for epoxide resin used for plastic resin coating, Araldite (Chiba Seihin Company: Tradename) is recommended. Particularly, the one using Araldite AY 103 (form: low-viscosity resin) as principal agent and HY953F (form: viscous fluid) as hardening agent, or the one Araldite AW 106 (form: high-viscosity resin) as principal agent and HV 953V (form fluid paste) as hardening agent are preferable. They become flexible coating after hardened which adheres well to concrete.

Said epoxide resin coating is applied to the outer peripheral surface of a sheath by either brush painting, or metal spraying, or spraying (especially air-spraying), or electrostatic spray painting, or fluidized-bed dip coating method, or upon the inner peripheral surface by either spraying (especially air-spraying), or electrostatic spray painting, or fluidized-bed dip coating method each to the thickness of preferably about 30 to 200 microns.

A Solid lubricating coating containing polytetrafluoroethylene resin (PTFE) is preferably applied to the inner peripheral surface of the metallic sheath by following method.

PTFE is preferably fine powder of 5 microns or less with apparent density 0.3 to 0.5 gr/cm$^3$ and specific gravity of 2.10 to 2.29—for example Fluon (tradename) of ICI in England and Hostatlon (tradename) of Hoechst in West Germany.

Soft metal fine powder which passes through 250 mesh (for example lead, tin, zinc, cadnium, and others) and/or metal sulfide fine powder of about 5 to 8 microns (for example molybdenum bisulfide, or tungsten bisulfide) are/is used as a suitable material as a carrier for PTFE fine powder.

As for binder for this PTFE or a mixture of PTFE and soft metal and/or metal sulfide, alkyd resin—especially styresol which is styrenated alkyd resin in which styrene is grafted into unsaturated group of said resin (Dai Nippon Ink & Chemical Inc.,: tradename) is recommended.

Said binder is added to said PTFE or the mixture of PTFE and soft metal and/or metal sulfide, then they are suspended in the volatile solvent (usually xylan or mineral turpentive is used) in order to produce suspension which is coated upon the inner peripheral surface of the sheath to provide a coating of thickness of 20 to 100 microns by spraying or the method like that.

Examples of compounding ratio of said components (excluding solvent) are, by volume ratio (VOL %), for example, (1) PTFE fine powder 50–70% styrene alkyd resin 30–50% (2) PTFE fine powder 20–60%, soft metal and/or metal sulfide 10–50%, and styrene alkyd resin 30–70%.

The compounding ratio in volume (vol %) of components, excepting solvent, is (1) 50–70% of PTFE fine powder and 30–50% of styrenated alkyd, and (2) 20–60% PTFE finepowder, 10–50% of soft metal and/or metal sulfide and 30–70% of styrenated alkyd.

The solid lubricating coating has, for itself, good rust-proofing property and, when used together with said phosphate coating and plastic resin coating, provides better rust-proofing property.

Moreover, the solid lubricating coating decreases the sliding frictional resistance (0.1–0.15 frictional coefficient) between inner peripheral surface of the metallic sheath and the tendon by great degree compared to conventional one (about 0.4 by frictional coefficient).

In addition, the solid lubricating coating is thin enough that it will not impair the flexibility of the metallic sheath while its adhesion property is excellent in spite of its thin thickness. Therefor it is difficult to peel off and is a good coating which has good property for the metallic sheath.

FIG. 1–4 show lateral cross sections of metallic sheathes. In these Figures, 1 is a main body of the hollow metallic sheath, 2 is a phosphate coating applied upon either outer or outer-and-inner peripheral surface of the metallic sheath, 3 is a synthetic resin coating made of epoxide or the like, and 4 is a solid lubricating coating containing polytetrafluoroethylene resin.

Figure 2:
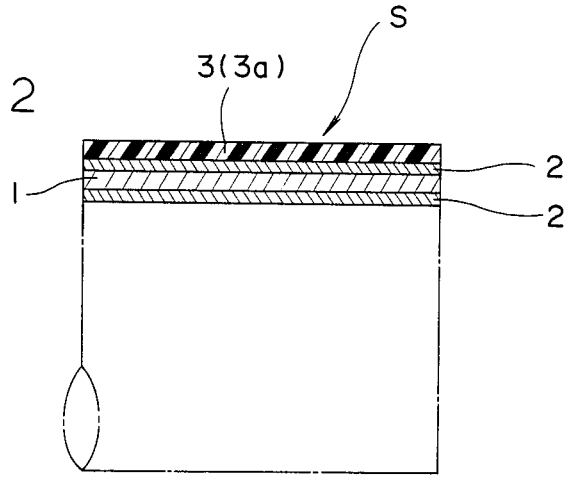
FIG. 2 shows a metallic sheath for a posttensioning method provided with phosphate coating on both outer and inner peripheral surfaces of the sheath and a plastic resin coating on an outer peripheral surface of the sheath.
Figure 3:
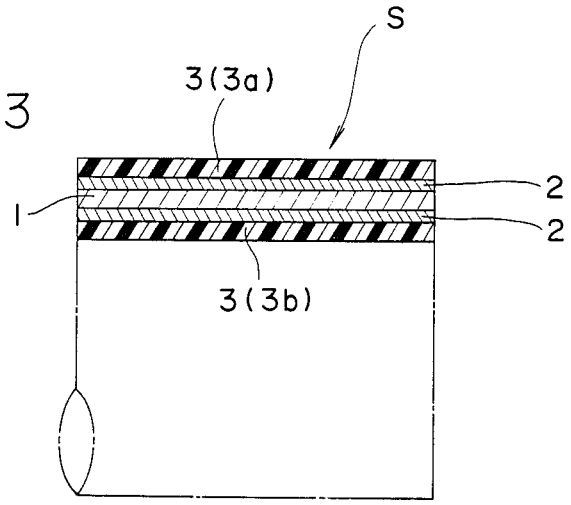
FIG. 3 shows a metallic sheath for a posttensioning method provided with phosphate and plastic resin coatings on both outer and inner peripheral surfaces of the sheath.
Figure 4:
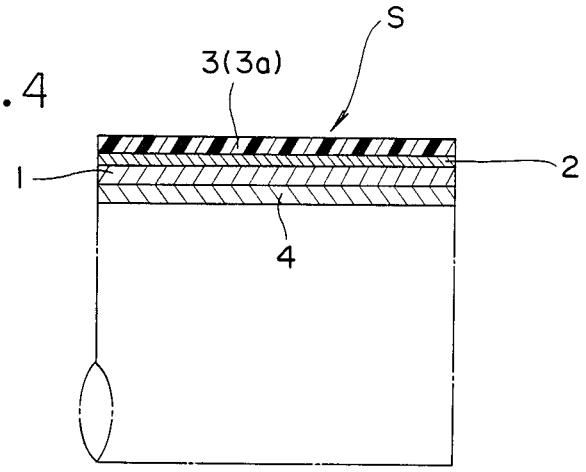
FIG. 4 shows the metallic sheath of FIG. 1 wherein a solid lubricating coating on the inner peripheral surface of the sheath is provided.

It is clear that the solid lubricating coating 4 can be applied to the sheathes of FIG. 2 & 3.

Having provided general discussion of the present invention and discribed specific embodiments in support thereof it is understood that modifications obvious to those skilled in the art are included within the spirit of this invention, and no undue restrictions are to be imposed by reasons thereof except as provided by the following claims.

What is claimed is:

1. A sheath or tube for encasing a tendon for the post-tensioning of concrete structural components exposed to corrosive chemicals consisting of:

(a) a metal tube;

(b) a corrosion inhibiting coating of a phosphate compound upon the inner and outer surfaces of said metal tube;

(c) an epoxy resin coating on the phosphate compound coating on the outer surface of said metal tube; and (d) a solid lubricant coating on the phosphate compound coating on the inner surface of said metal tube, said solid lubricant coating comprising 20–60 volume percent of polytetrafluoroethylene, 10–50 volume percent of a soft metal, a metal sulfide or a mixture thereof, and 30–70 volume percent of a styrenated alkyd as a binder.

2. A sheath or tube for encasing a tendon for the post-tensioning of concrete structural components exposed to corrosive chemicals consisting of:

(a) a metal tube;

(b) a corrosion inhibiting coating of a phosphate compound coated upon the inner and outer surfaces of said metal tube;

(c) an epoxy resin coating on the corrosion inhibiting phosphate compound coating on both the inner outer surfaces of said metal tube; and (d) a solid lubricant coating on the resin coating on the inner surface of said metal tube, said solid lubricant coating comprising 20–60 volume percent of polytetrafluoroethylene, 10–50 volume percent of a soft metal, a metal sulfide or a mixture thereof, and 30–70 volume percent of a styrenated alkyd as a binder.

* * * * *